US006113423A

United States Patent [19]

Hwang

[11] Patent Number: 6,113,423

[45] Date of Patent: Sep. 5, 2000

[54] PANEL ATTACHMENT FOR ELECTRICAL CONNECTOR

[75] Inventor: Jeng-Yih Hwang, Santa Clara, Calif.

[73] Assignee: Hon Hai Precision Ind. Co., Ltd., Taipei Hsien, Taiwan

[21] Appl. No.: 09/351,924

[22] Filed: Jul. 12, 1999

[51] Int. Cl.[7] ..... H01R 13/74

[52] U.S. Cl. ..... 439/557

[58] Field of Search ..... 439/248, 557, 439/247, 567; 248/27.3; 411/508

[56] References Cited

U.S. PATENT DOCUMENTS 4,988,308 1/1991 Toedtman ..... 439/557

5,017,151 5/1991 Peterson ..... 439/557

5,286,222 2/1994 Yagi et al. ..... 439/557

*Primary Examiner*—Gary F. Paumen

*Attorney, Agent, or Firm*—Wei Te Chung

[57] ABSTRACT

A panel attachment for attaching an electrical connector to a panel having at least a hole therein, the attachment comprises a base plate. A supporting upright extends from the base plate through the hole of the panel. A pair of deflectable vane sectors extends outward and downward from a tip of the upright toward the base plate to an extent such that a gap is defined between free ends of the vane sectors and the base plate. Flexible strips are formed between the upright and the vane sectors for limiting over-stretching of the vane sectors.

6 Claims, 7 Drawing Sheets

PANEL ATTACHMENT FOR ELECTRICAL CONNECTOR

FIELD OF THE INVENTION

The present invention relates to a panel attachment, and more particularly to a panel attachment having flexible strip for prevent over-stretching of anchoring vanes.

DESCRIPTION OF PRIOR ART

Many prior art connectors have been provided with means for attaching the connector to a panel. Even the prior art panel mounted connector may readily be assembled to the panel, one problem needs to be solved is the backward movement of the connector during mating with a complementary connector. This is because the panel mounted connector is mounted to the panel from a bottom face of the panel. When the complementary connector is mated from a top face of the panel, the panel mounted connector is pushed downward with respect to the panel.

U.S. Pat. No. 4,988,308 discloses a panel mount having spiral vanes extending helically along the length of a support post. Even the configuration is extremely effective, free ends of the spiral vanes are vulnerable to deflect when excess mating force is exerted thereto, especially when incorrect complementary connector is mated thereto.

SUMMARY OF THE INVENTION

It is an objective of this invention to provide a panel attachment having flexible strip to prevent over-stretching of anchoring vane sectors.

In order to achieve the objective set forth, a panel attachment for attaching an electrical connector to a panel having at least a hole therein, the attachment comprises a base plate. A supporting upright extends from the base plate through the hole of the panel. A pair of deflectable vane sectors extends outward and downward from a tip of the upright toward the base plate to an extent such that a gap is defined between free ends of the vane sectors and the base plate. Flexible strips are formed between the upright and the vane sectors for limiting over-stretching of the vane sectors.

According to an aspect of the present invention, flexible strips are formed between two adjacent vane sectors to limit over-stretching of the vane sectors.

These and additional objects, features, and advantages of the present invention will become apparent after reading the following detailed description of the preferred embodiments of the invention taken in conjunction with the appended drawing.

DETAILED DESCRIPTION OF PREFERRED EMBODIMENT

Figure 1:
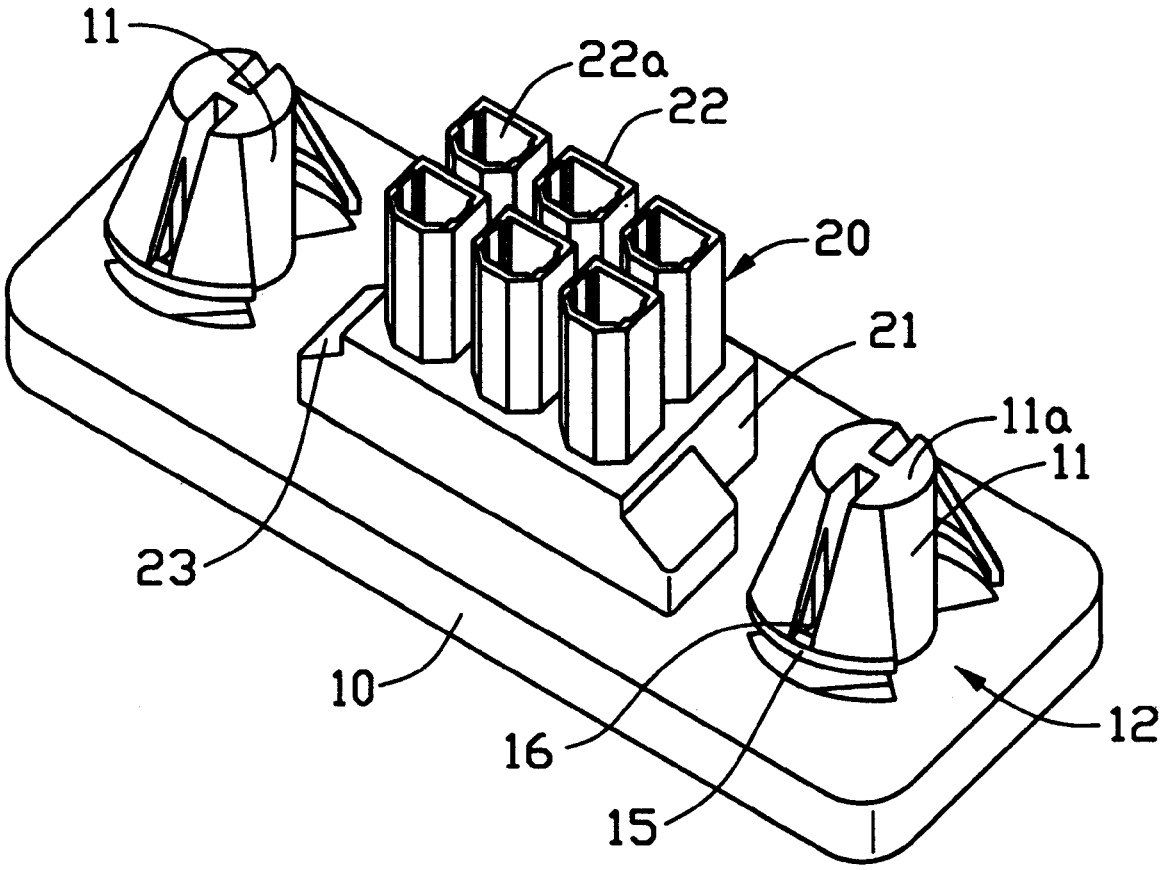
FIG. 1 is a perspective view of a panel attachment with a connector thereon.
Figure 2:
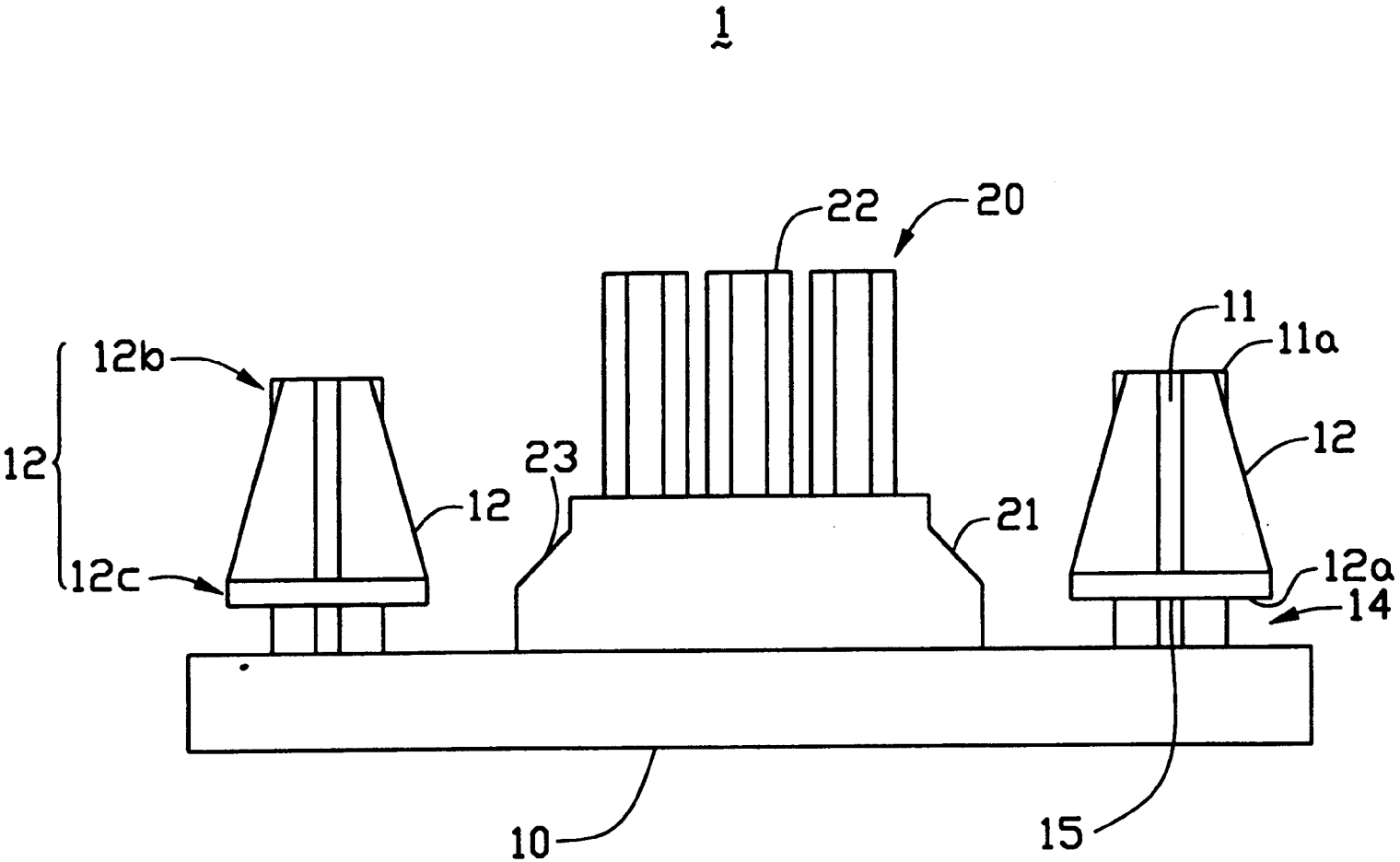
FIG. 2 is a front view of FIG. 1.
Figure 3:
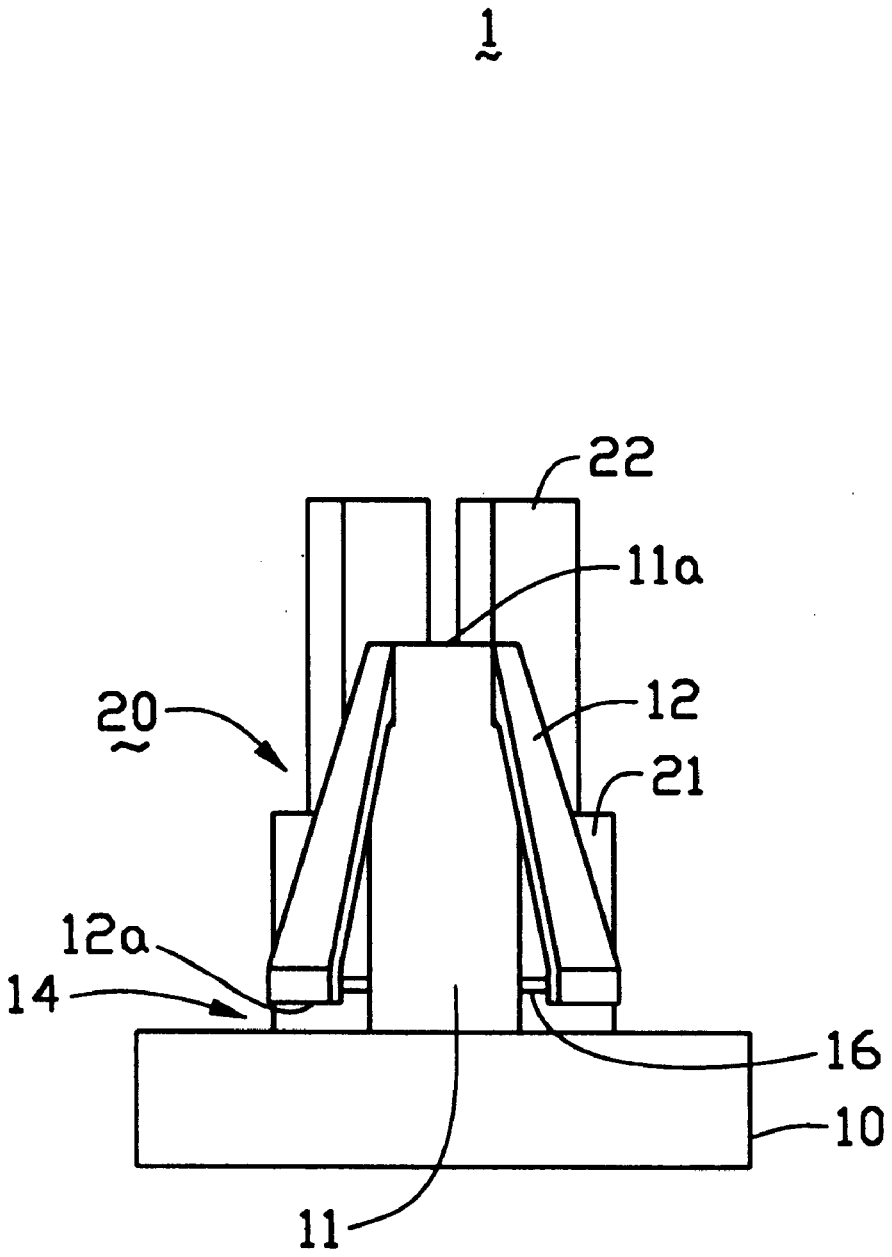
FIG. 3 is an end view of FIG. 1.
Figure 4:
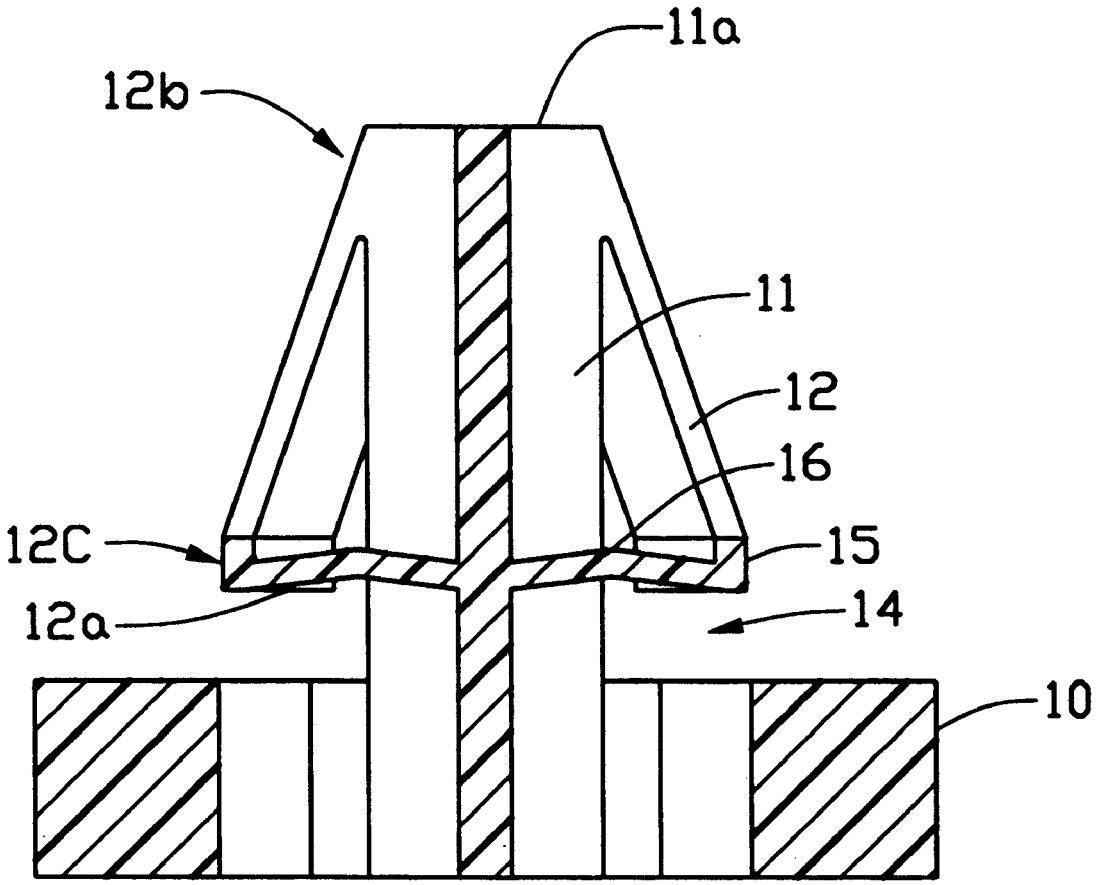
FIG. 4 is a cross sectional view taken along line IV—IV of FIG. 2.

Referring to FIGS. 1, 2, 3 and 4, a panel attachment 1 in accordance with the present invention comprises a base plate

10. A pair of supporting upright 11 extends from opposite ends 10*a* of said base plate 10. The supporting uprights 11 are integrally formed with the base plate 10. Two pair of deflectable vane sectors 12 extend outward and downward from a tip 11*a* of said upright 11 toward said base plate 10 to an extend such that a gap 14 is defined between lower ends 12*a* of said vane sectors 12 and said base plate 10. The deflectable vane sectors 12 generally form a frusto-conical shape thereby defining a top 12*b* and a base 12*c* which is larger than the top 12*b* in diameter. Since each vane sector 12 is cantilevered to the upright 11, the vane sector 12 can move toward the upright when the lower end 12*a* is squeezed inward thereby reducing the diameter thereof.

According to the preferred embodiment, each individual vane sector 12 is interconnected by a bridge 15 which is further interconnected to a root portion 11 b of the upright 11 by a flexible strip 16 extending generally along a redial direction. By this arrangement, outward movement of the lower end 12*a* of the vane sector 12 is limited. As a result, permanent deformation of the vane sectors 12 is therefore eliminated.

A housing 21 of an electrical connector 20 is integrally formed with the base plate 10. The housing 21 further forms an array of silos 22 each defining a receiving space 22*a* therein for mounting a terminal therein (not shown). The housing 21 further includes side blocks 23 for polarization.

Figure 5:
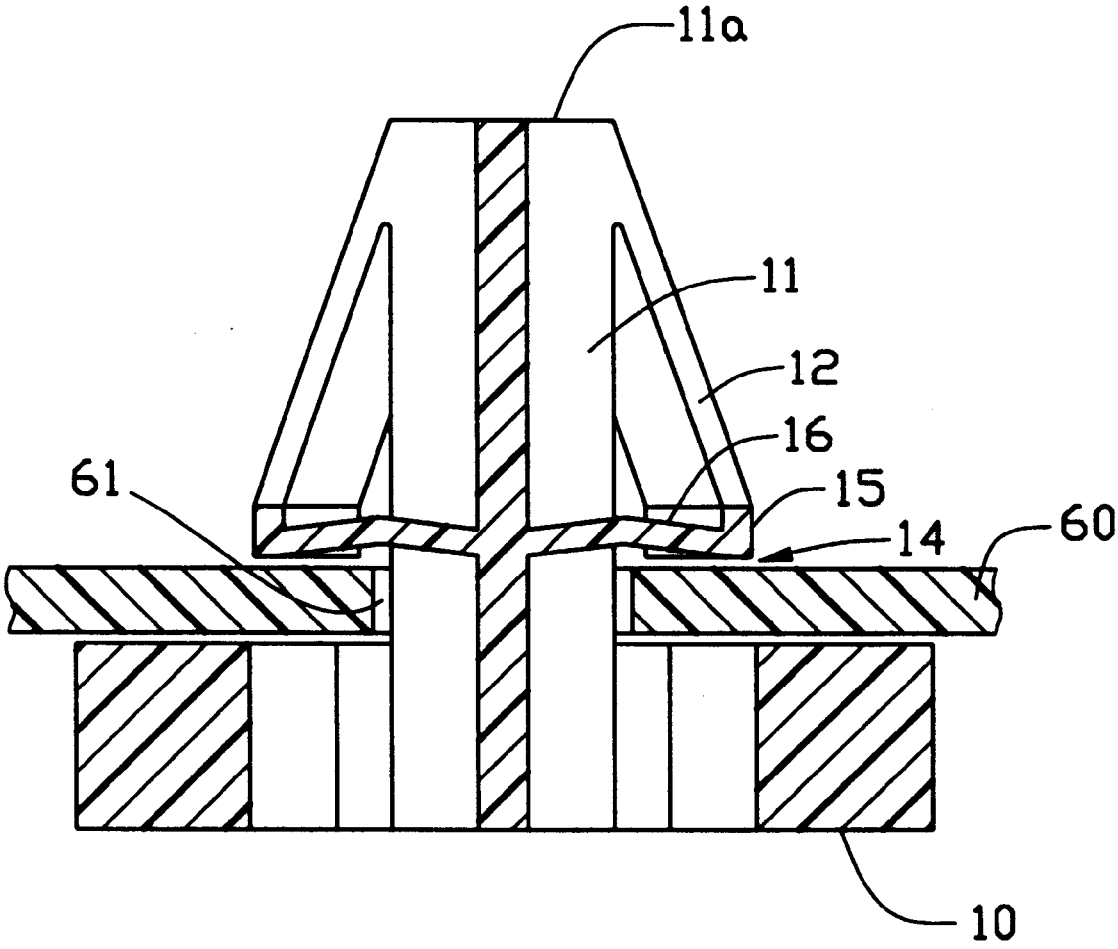
FIG. 5 is similar to FIG. 4 showing the panel attachment is assembled to a panel.
Figure 6:
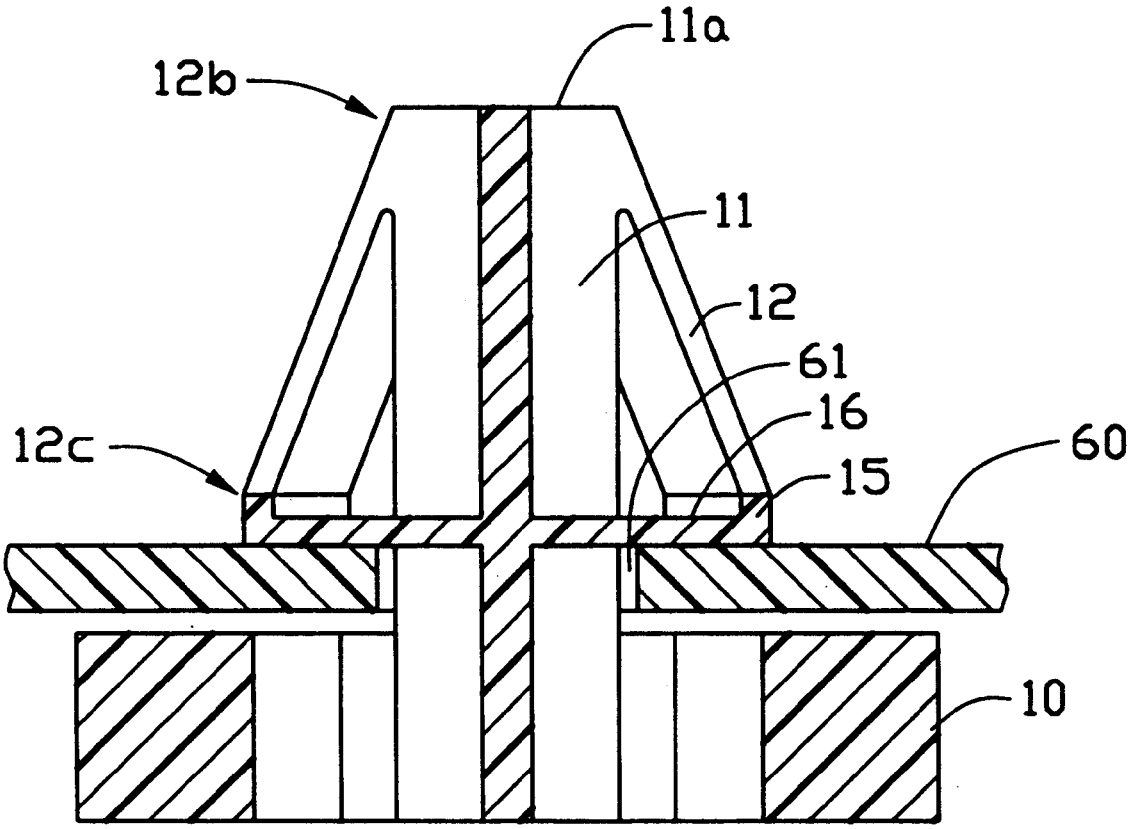
FIG. 6 is similar to FIG. 5 showing vane sectors are limited from over-stretching by the help of strips.

Referring to FIGS. 5 and 6, in assembly the top 12*b* of the panel attachment 1 may readily extends through a hole 61 defined in a panel 60. Since each vane sector 12 is cantilevered to the upright 11, the lower ends 12*a* of the vane sector 12 can deflect inward such that the lower end 12*a* thereof may slide over the inner rim of the hole 61. Finally, the panel 60 is floatably located in the gap 14 defined between the lower ends 12*a* and the base plate 10. When the lower end 12*a* of the vane sector 12 is moved inward, the strip 16 is also deflected upward to make the inward movement of the vane sector 12 possible. In addition, when the lower ends 12*a* pass over the inner rim of the hole 61, the lower ends 12*a* are moved outward by its potential resilient force and the extension of the strip 16. This ensure the lower ends 12*a* to move further away from the hole 61 thereby providing reliable attachment.

Figure 7:
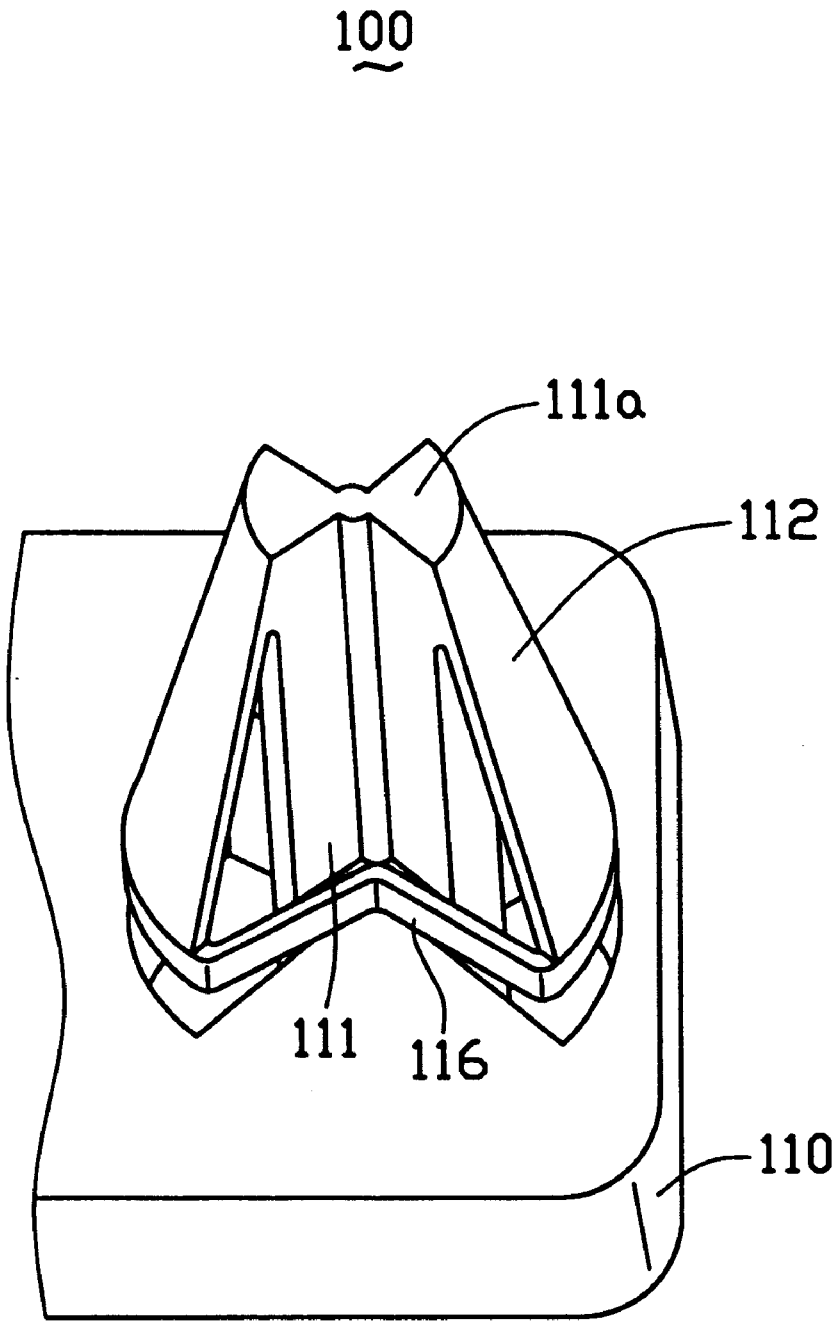
FIG. 7 is a perspective view of a second embodiment in accordance with the present invention.

FIG. 7 is a panel attachment 100 in accordance with a second embodiment of the present invention. The panel attachment 100 includes a base plate 110 having an upright 111 extending therefrom. A pair of vane sectors 112 symmetrically extends outward and downward from a top 111*a* of the upright 111. The vane sectors 112 are interconnected by an inwardly deflectable strip 116 generally extending along a circumferential path of lower edges of said pair of van sectors 112 thereby limiting the over-stretch of the vane sectors 112.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A panel attachment for attaching an electrical connector to a panel having at least a hole therein, said attachment comprising:

a base plate;

a supporting upright extending from said base plate through said hole of said panel;

at least a deflectable vane sector extending outward and downward from an upper portion of said upright toward said base plate to an extent such that a gap is defined between a free end of said vane sector and said base plate; and interconnecting means between said upright and said vane sector for limiting over-stretching of said vane sector;

wherein said interconnecting means is a flexible strip bridging between a lower end of said van sector and a root portion of said upright; and wherein said deflectable vane sector forms a part-conical shape having an upper end smaller than said hole and a base larger than said hole.

2. The panel attachment as recited in claim 1, wherein said gap is approximately equal to a thickness of said panel.

3. A panel attachment for attaching an electrical connector to a panel having at least a hole therein, said attachment comprising:

a base plate;

a supporting upright extending from said mounting panel through said hole of said panel to a distance;

a pair of deflectable vane sectors extending outward and downward from an upper portion of said upright toward said base plate to an extend such that a gap is defined between free ends of said vane sectors and said base plate; and interconnecting means between two adjacent vane sectors for limiting over-stretching of said vane sectors.

4. An electrical system, comprising:

a panel having at least a mounting hole therein;

an electrical connector adapted to be secured to said panel; and at least a panel attachment engageable to said mounting hole for attaching said electrical connector to said mounting panel, said panel attachment including a base plate on which said electrical connector is seated, at least a supporting upright extending from said base plate through said hole of said panel, deflectable vane sectors extending outward and downward from an upper portion of said upright toward said base plate to an extend such that a gap is defined between a free end of said vane sectors and said base plate, and interconnecting means for limiting outwardly over-stretching of said vane sectors, wherein said interconnecting means includes at least a flexible strip between two adjacent vane sectors.

5. The electrical system as recited in claim 4, wherein a housing of said connector is integrally formed with said base plate.

6. The electrical system as recited in claim 4, wherein said strip extends generally along a circumferential path of lower edges of said two vane sectors.

* * * * *